United States Patent [19]

Okuda

[11] 4,312,472

[45] Jan. 26, 1982

[54] THUMBTACK TACKER

[76] Inventor: Tsunehito Okuda, 42 Morishita-cho, Higashi-ku, Nagoya-shi, Aichi-ken 461, Japan

[21] Appl. No.: 112,317

[22] Filed: Jan. 15, 1980

[30] Foreign Application Priority Data

Jan. 22, 1979 [JP] Japan ..... 54-6335

[51] Int. Cl.[3] ..... B25C 1/02

[52] U.S. Cl. ..... 227/113; 227/120; 227/114; 227/117; 227/118

[58] Field of Search ..... 227/113, 114, 115, 116, 227/117, 118, 120, 147, 119

[56] References Cited

U.S. PATENT DOCUMENTS

| | | | |
|---|---|---|---|
| 280,404 | 7/1883 | Root | 227/120 X |
| 527,985 | 10/1894 | Hoofnagle | 227/119 X |
| 1,041,884 | 10/1912 | Sasseman | 227/119 |

*Primary Examiner*—Paul A. Bell

*Attorney, Agent, or Firm*—Armstrong, Nikaido, Marmelstein & Kubovcik

[57] ABSTRACT

A thumbtack tacker tacking thumbtacks by pushing action comprising a case provided with a arc-shaped housing portion housing a lot of thumbtacks inside the case, an arm provided with a V-shaped pick-up member picking up a thumbtack inside the arc-shaped housing portion along the arc-shaped face of the arc-shaped housing portion at the tip and pivoted inside the case, a working slide provided with a suspended portion engaging the arm and supported as swingable to the back and front of the case with the front end of the arm faced the front of the case, and a reversing plate provided with a magned attracting the thumbtack picked up by the pick-up member, being pivoted as reversible to the front face of the case.

4 Claims, 5 Drawing Figures

THUMBTACK TACKER

BACKGROUND OF THE INVENTION (1) Field of the Invention

The present invention relates to a thumbtack tacker capable of tacking thumbtacks contained in a case thereof automatically to the surface of a wall by means of pushing pressure of the case.

(2) Description of the Prior Art

It has been done so far by manual work to thumbtack paintings and writings and the like on the surface of a wall. There has been a lot of steps required to tack them where a lot of thumbtacks are used such as in a school. Also, it has been not only troublesome but also inefficient to tack each pieces of thumbtack out of a container holding a lot of thumpins, being liable to prink a finger tip with a needle point.

SUMMARY OF THE INVENTION

The present invention relates to a thumbtack tacker tacking thumbtacks by pushing action comprising a case provided with a arc-shaped housing portion housing a lot of thumbtacks inside the case, an arm provided with a V-shaped pick-up member picking up a thumbtack inside the arc-shaped housing portion along the arc-shaped face of the arc-shaped housing portion at the tip and pivoted inside the case, a working slide provided with a suspended portion engaging the arm and supported as swingable to the back and front of the case with the front end of the arm faced the front of the case, and a reversing plate provided with a magnet attracting the thumbtack picked up by the pick-up member, being pivoted as reversible to the front face of the case.

It is an object of the present invention to provide a thumbtack tacker capable of tacking thumbtacks automatically to the surface of a wall with the operation of pushing a case containing thumbtacks ahead.

The further objects and features of the present invention will be apparent in the following description according to the accompanying drawings. It is to be understood, however, that the drawings are presented for the purpose of illustration only and are not intended as limitation of the scope of the invention.

DESCRIPTION OF THE PREFERRED EMBODIMENT

Figure 1:
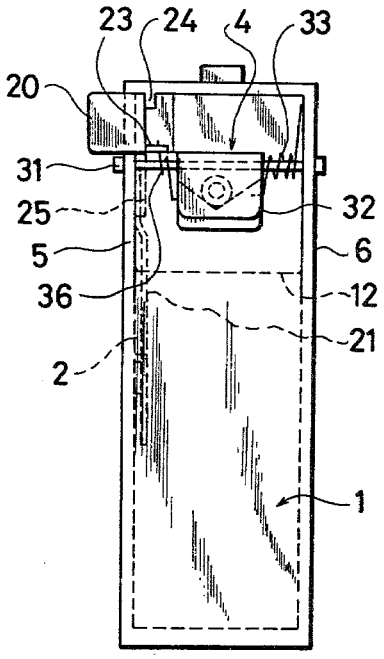
FIG. 1 is a front view of a thumbtack tacker of an example of the present invention.
Figure 4:
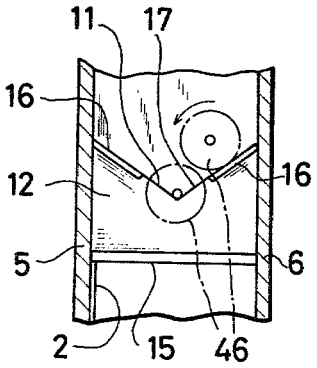
FIG. 4 is a front cut-out sectional view of a pick-up member.
Figure 5:
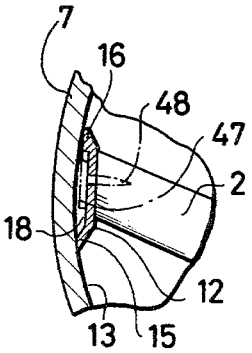
FIG. 5 is a right side cut-out sectional view of the said member.

Referring now to the several figures, it may be seen that the tacker of the present invention comprises a case 1, an arm 2, a working slide 3, and a reversing plate 4. The case 1 forms a main block 8 providing an arc-shaped plate 7 between a right side plate 5 and a left side plate 6 and forms an arc-shaped housing portion 9 forming an arc shape from the front to the bottom inside the main block 8. An arm 2 is located at the center of the arc-shaped housing portion 9, provided with an arm block 10 pivoted to the right side plate 5 and a V-shaped pick-up member 12 having a V-shaped groove 11 at the head of the arm block 10. And the V-shaped pick-up member is formed as slidable along an arc-shaped face 13 of the arc-shaped housing portion 9 due to the swinging of the arm block 10 which is arranged with a pin 14 engaging a slot 22 of the working slide 3 to be described later. As shown in FIGS. 4 and 5, the V-shaped pick-up member 12 forms a space 18 between a center portion 17 of the V-shaped groove 11 and the arc-shaped face 13 of the arc-shaped housing portion, with its lower edge 15 and a right and left portion 16 of the V-shaped groove given access to the arc-shaped face 13 of the arc-shaped housing portion.

The working slide 3 places a turning front end 20 for confronting the wall of a sliding block 19 to the front face of the case 1 being in contact with the inside of the side plate 5 and engages the slot 22 of the head of a suspended portion 21 hanging down to the rear end of the sliding block 19 with the pin 14 of the arm. The sliding body 19 is inserted in and penetrates the front face of the case 1. A dog 23 for working the reversing plate 4 is arranged at a required place of the sliding block 19. The sliding block 19 is guided and supported as slidable to the back and front by guiding plates 24 and 25 arranged in the case 1, the side plate 5 and an upper face wall 26 of the case 1. A spring 28 is loaded between a convex portion 27 arranged on the sliding block 19 and the upper front wall portion of the case 1. The spring pushes the sliding block 19 to the front, and the suspended portion comes in contact with a rear edge 29 for stopping the guiding plate 25.

The reversing plate 4 is located at a cave-in portion 30 arranged in the upper front portion of the case 1 and a reversing plate block 32 is pivoted to the case 1 by a pin 31. A returning spring 33 is loaded between the reversing block 32 and the case 1. The returning spring 33 pushes the reversing plate block 32 counterclockwise in FIG. 2 and places the block 32 on the front of the case 1. A magnet 34 embedded in the one side center of the reversing plate block 32 is located as facing a perforation 35 arranged on the front wall of the case 1, corresponding to the returning position of the aforementioned V-shaped pick-up member 12 and a spring type feeling bar 36 to be touched to the dog 23 is attached to the reversing plate block 32. And in FIG. 2, 37 is a cover plate thumscrewed on the top face of the case 1 and 38 is a handle attached to the back of the case 1.

In using the aforementioned tacker, the cover plate 37 is opened and a lot of thumbtacks as much as the height shown by a phantom line 39,e.g., 200 pieces are charged into the arc-shaped housing portion 9.

Figure 2:
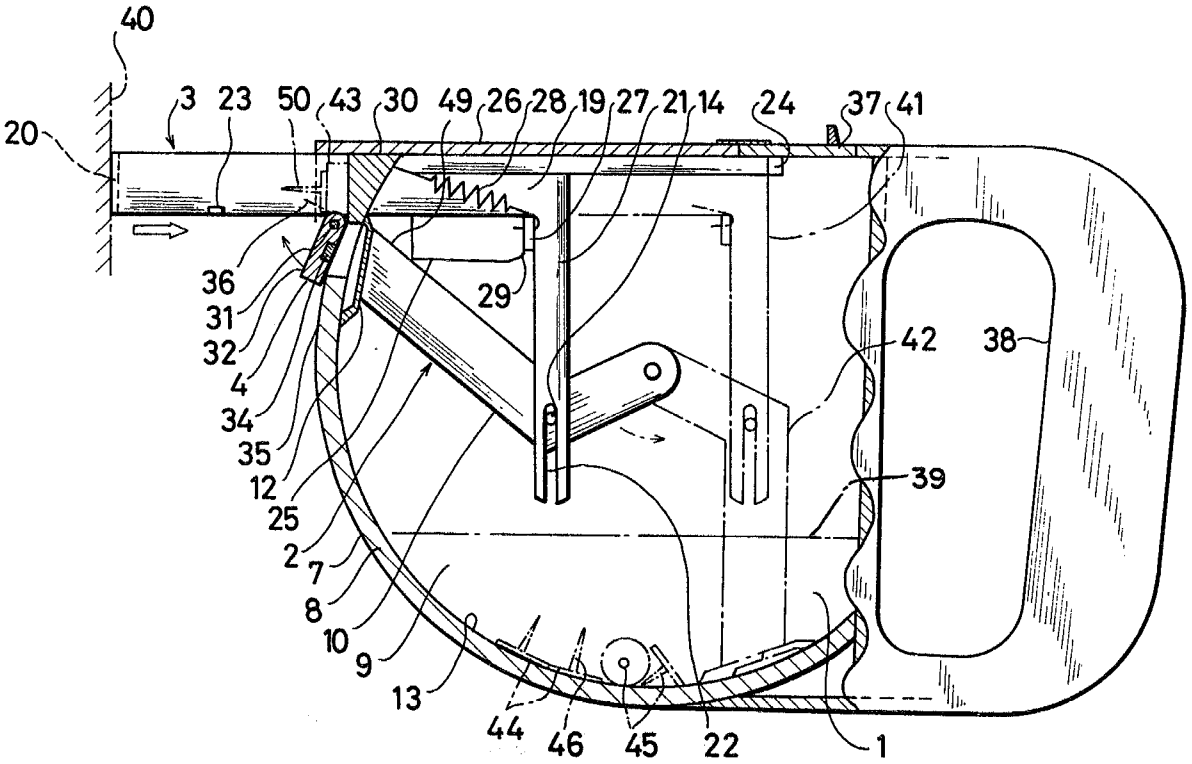
FIG. 2 is a partially cut-out right side view of the said tacker.
Figure 3:
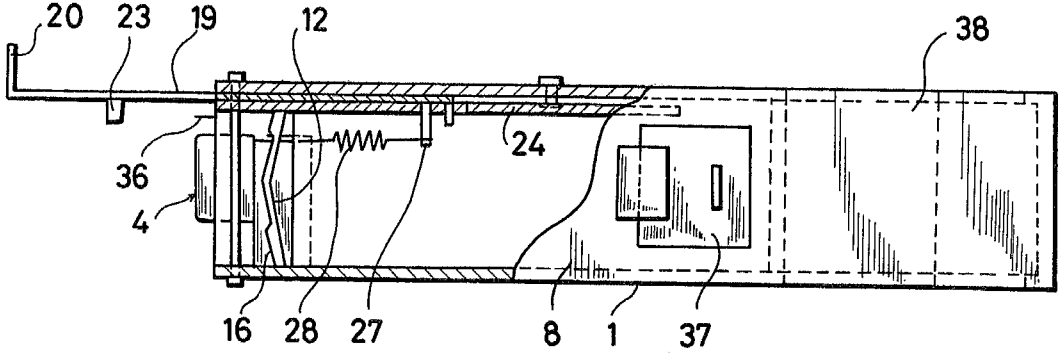
FIG. 3 is a partially cut-out plan view of said tacker.

Accordingly, as shown in FIG. 2, pushing the case 1 to the front against the tension of the spring 28 by grasping the handle 38, with the front end 20 of the working slide touched to the wall face 40 and the like, the working slide 3 goes backward relatively to the case 1 as shown by a phantom line 41, so that the arm 2 engaged by the pin 14 rotates counterclockwise as shown by a phantom line 42 and the working slide 3 brings the front end 20 into contact with the case 1 at the rotated position. The working slide 3 reverses the reversing plate 4 counterclockwise in FIG. 2 against the elastic force of a returning spring 33 on the way to the back by working the feeling bar 36 with the dog 23, and the reversing plate 4 comes in contact with the cave-in portion 30 as shown by a phantom line 43 just before the working slide 4 reaches the end of the going way. And the retrogression of the dog 23 after the reversing plate 4 reaches the reversing position is compensated by the bending of the feeling bar 36. On the other hand, the thumbtack inside the arc-shaped housing portion 9 are pushed to the upper back by the V-shaped pick-up member 12 with the rotation of the arm 3 and are rolled down to the front by the deal load. The rolled down thumbtacks become mostly thumbtacks 44 in the state of placing the head on the arc-shaped face 13 at the bottom of the arc-shaped housing portion 9 due to the condition of the shape and balance. Therefore, returning the case 1 to the original state reversely to the aforementioned, the working slide 3 rotates the arm 2 to the original state by restoring itself to the front by means of the restoring force of the spring 28. On the way of rotating to the original state, the V-shaped pick-up member 12 removes a thumbtack 45 other than the thumbtacks 44 to a center portion 17 by a slanted right and left portion 16 as shown in FIG. 4. A head 47 of the thumbtack 46 is half hidden in a space 18 as shown in FIG. 5 and a pin needle 48 becomes a state of being supported by the center 17 and faces the perforation 35 at the restoring rotating end of the V-shaped pick-up member 12.

On the other hand, since the dog 23 gets out of the feeling bar 36 on the way back to the original state of the working slide 3, the reversing plate 4 faces the perforation 35 by means of the restoring force of the returning spring 33 and the head of the thumbtack 46 facing the perforation 35 is attracted to the reversing plate 4 by attraction of a magnet 34 as shown by a phantom line 49. And the thumbtacks 44 ahead and the thumbtack 46 supported by the V-shaped pick-up member 12 when it is rotating to the original state, is removed by the thumbtack 46 or the V-shaped pick-up member 12 or goes to the upper front portion of the arc-shaped housing portion 9 and falls down to the center of the arc-shaped housing portion 9.

Putting the case 1 into the second operation as the same way as the aforementioned, the thumbtack attracted by the reversing plate 4 with its reversal becomes a state facing the pin needle forward as shown by a phantom line 50, so that the thumbtack is tacked on the wall face 40 and the like in the state the case 1 is pushed to the front and positioned at the end of the going way. Therefore, facing the paintings and writings and the like to be put on the surface of the wall 40 and pushing the case 1, the thumbtacks can be automatically tacked and paintings and writings are put up by the thumbtacks.

Then, tacking operation of thumbtacks thereafter is done at each reciprocating operation of the case 1 as the aforementioned. And it happens sometimes that a thumbtack is not supported by the V-shaped pick-up member 12 due to the poor aspect of the thumbtack, but it is good to swing the case 1 for changing the position of the thumbtack and to handle the case again. And it is desirable to supply thumbtacks before the quantity of thumbtack inside the arc-shaped housing portion 9 becomes too small.

What is claimed is:

1. A thumbtack tacker tacking thumbtacks by pushing action comprising:

(a) a case provided with an arc-shaped housing portion for holding a plurality of thumbtacks inside the case;

(b) an arm having a V-shaped pick-up member pivotally mounted in said case for picking up a thumbtack inside said arcshaped housing portion along the arc-shaped face of said arc-shaped housing portion (c) a working slide slidably supported in said case, said working slide having a suspended portion engaging said arm wherein, when said working slide slides in said case, the front end of the arm moves along said arc-shaped housing portion;

(d) a reversing plate pivotally mounted on said arc-shaped portion, said reversing plate having a magnet thereon for attracting said thumbtack picked up by said pick-up member, and positioning said thumbtack in front of said working slide, such that said working slide can drive said thumbtack into an object.

2. A thumbtack tacker as recited in claim 1 further comprising a spring positioned between said working slide and said case, for biasing said working slide towards the exterior of said case.

3. A thumbtack tacker as recited in claim 1 wherein said case has an opening at a predetermined position of movement of said pick-up member and said thumbtack is attracted by said magnet of said reversing plate through said opening.

4. A thumbtack tacker as recited in claim 1 further comprising a dog extending from the working slide, a spring type feeling bar extending from said reversing plate for engaging said dog due to the movement of said dog, and thereby pivoting said reversing plate and a returning spring for biasing said reversing plate toward a normal position when not engaged by said dog.

* * * * *